United States Patent [19]

Terlecke et al.

[11] Patent Number: 4,833,756

[45] Date of Patent: May 30, 1989

[54] BENDABLE DRAPERY ROD ASSEMBLY

[75] Inventors: Mark J. Terlecke, Middleton; John S. Reback, Blue Mounds, both of Wis.

[73] Assignee: Graber Industries, Inc., Middleton, Wis.

[21] Appl. No.: 151,295

[22] Filed: Feb. 1, 1988

[51] Int. Cl.[4] ..... A47H 1/04; E05D 15/00; E05D 15/06

[52] U.S. Cl. ..... 16/87.2; 16/87.4 R; 16/94 D; 16/95 D; 16/96 D; 160/345

[58] Field of Search ..... 16/93 D, 94 D, 95 D, 16/96 D, 96 L, DIG. 31, 87.2, 87.4 R, 87.6 R, 93 R, 94 R, 95 R, 96 R; 160/126, 345, 346, 347; 211/105.1, 105.2

[56] References Cited

U.S. PATENT DOCUMENTS

| | | | |
|---|---|---|---|
| 2,790,558 | 4/1957 | Rosenbaum | 16/87.4 R |
| 2,913,212 | 11/1959 | Bell | 160/345 |
| 3,346,227 | 10/1967 | Hankin . | |

FOREIGN PATENT DOCUMENTS

| | | | |
|---|---|---|---|
| 254075 | 7/1963 | Australia | 16/96 R |
| 2649149 | 6/1978 | Fed. Rep. of Germany | 16/960 |
| 545742 | 6/1942 | United Kingdom . | |
| 1246291 | 9/1971 | United Kingdom . | |

OTHER PUBLICATIONS

Publication pp. 102 and 103 entitled "Graber Workroom Tools and Accessories", from Graber Drapery Fixtures General Catalog No. 0066, published 1967 by the Graber Company.

Publication entitled "Sears Best—Super-Luxe Universal Traverse Rod", by Swish.

*Primary Examiner*—Nicholas P. Godici
*Assistant Examiner*—William S. Andes
*Attorney, Agent, or Firm*—Vernon J. Pillote

[57] ABSTRACT

A bendable drapery rod assembly comprising an elongated plastic rod member formed of flexible plastic and defining a trackway for drapery carriers, an elongated metal rod member, and provision for laterally retaining the plastic rod member and metal rod member together along their length to provide a combination plastic and metal rod unit. The metal rod member has a cross section with a major crosswise dimension and a relatively smaller minor crosswise dimension disposed transverse to the major crosswise dimension, and the rod unit is bendable in a direction laterally of the minor crosswise dimension of the metal rod member into a curved condition. The metal rod member is ductile and adapted to take a permanent set to hold the rod unit in a curved condition, and the major crosswise dimension of the metal rod member is substantially greater than the minor crosswise dimension to stiffen the rod unit against bending in a direction laterally of the major crosswise dimension.

17 Claims, 1 Drawing Sheet

BENDABLE DRAPERY ROD ASSEMBLY

BACKGROUND OF THE INVENTION

While most drapery rod installations use straight drapery rods, there are some installations such as bowed and bay windows and room corners in which it is desirable to bend or curve the rod to conform to the windows or corners. Drapery rod installations in bow windows require bending the drapery rod to a relatively large radius of a curvature corresponding to that of the bow window, while bay windows and corners involve bending of the rod in one or more sections to a relatively small radius of curvature, for example of the order of 12 or 15 inches, with other sections of the drapery rod remaining generally straight. The radius of curvature of bow windows and the angles and size of the individual sections of bay windows vary in different installations, and it is generally necessary to custom bend the rod for each different installation.

Conventional metal drapery rods are difficult to bend without distorting the drapery trackway, especially in small radius bends of the order of 12 or 15 inches. It has been proposed to bend some drapery rods formed of metal by using bending tools similar to pipe bending tools and a flexible filler member which is inserted into the drapery rod before bending to reduce distortion of the trackway, and removed from the drapery rod after bending. It has also been proposed to bend steel drapery rods by forming a series of thin vertical cuts part way through the rod at the inner side of the bending curve so that the rod can be segmentally bent down to a relatively small radius curve. However, the slits weaken the drapery rod section and, to maintain strength, two rod sections are used, one inside the other.

It has also been proposed to form drapery rods of plastic, for example as disclosed in U.S. Pat. No. 3,346,227. In order to provide adequate strength for supporting the draperies, the rod must be formed of a plastic material that is rigid at normal room temperatures and with wall sections sufficiently thick to provide adequate strength for supporting the draperies. Drapery rods formed of rigid plastic material such as rigid polyvinylchloride, are flexible and can be bent at normal room temperatures, but tend to straighten when the bending forces are released. The rod mounting brackets cannot reliably hold such resilient plastic rod members in small radius curves such as 12 or 15 inches. In order to produce small radius curves with a more permanent bend in such plastic drapery rods, it has been proposed to submerge the section of the rod to be bent in hot water at a temperature and for a time sufficient to heat the plastic material to a softening temperature; remove the rod from the water; bend the rod to the desired curve, and thereafter hold the rod in the bent condition until it cools and sets. This not only requires a tank or receptacle of sufficient size to submerge at least the section of the rod to be bent, and means for heating and maintaining the water heated to a temperature sufficient to soften the plastic, but also presents the potential hazard of user burns from the hot water and/or heated plastic rod.

SUMMARY OF THE INVENTION

It is the general object of the present invention to provide a drapery rod which is easily bendable laterally in a horizontal direction into a permanent curve and which is strong and resistant to bending in a vertical direction, to provide adequate strength for supporting drapery panels.

A more particular object of this invention is to provide a drapery rod in accordance with the foregoing object, and which is bendable by hand in a horizontal direction, without requiring heating of the rod or special tools or equipment, to bend the rod to a desired curve.

Accordingly, the present invention provides a bendable drapery rod assembly comprising an elongated plastic rod member formed of flexible plastic and including lengthwise extending rail means defining a trackway for drapery carriers, and an elongated metal rod member of ductile metal having a major crosswise dimension and a minor crosswise dimension transverse to the major crosswise dimension, and means for laterally retaining the plastic and metal rod members together along their length to provide a combination plastic and metal rod unit. Rod mounting means are provided to mount the rod unit with the major crosswise dimension of the metal rod member disposed vertically. The rod unit is bendable in a direction laterally of the minor crosswise dimension of the metal rod member into a curved condition and the metal rod member is ductile and adapted to take a permanent set when bent to aid in retaining the metal and plastic rod unit in a curved condition. The major crosswise dimension of the metal rod member is substantially greater than its minor crosswise dimension to stiffen the rod unit against bending laterally of its major crosswise dimension.

In a presently preferred embodiment of the drapery rod assembly, the elongated plastic rod member has a generally C-shaped cross section with a lengthwise extending vertical wall portion and rail means extending laterally from one side of the vertical wall portion to provide a trackway for drapery carriers at one side of the vertical wall portion, and the elongated metal rod member has a vertical wall portion disposed along the other side of the vertical wall portion of the plastic rod member, and lengthwise extending flange means on one of the rod members engages the other of the rod members to laterally retain the vertical wall portions of the rod members together while accommodating limited relative movement therebetween in a direction lengthwise of the rod members, to facilitate bending of the rod unit.

DETAILED DESCRIPTION

Figures 1, 2, 3, 4, 5, 6:
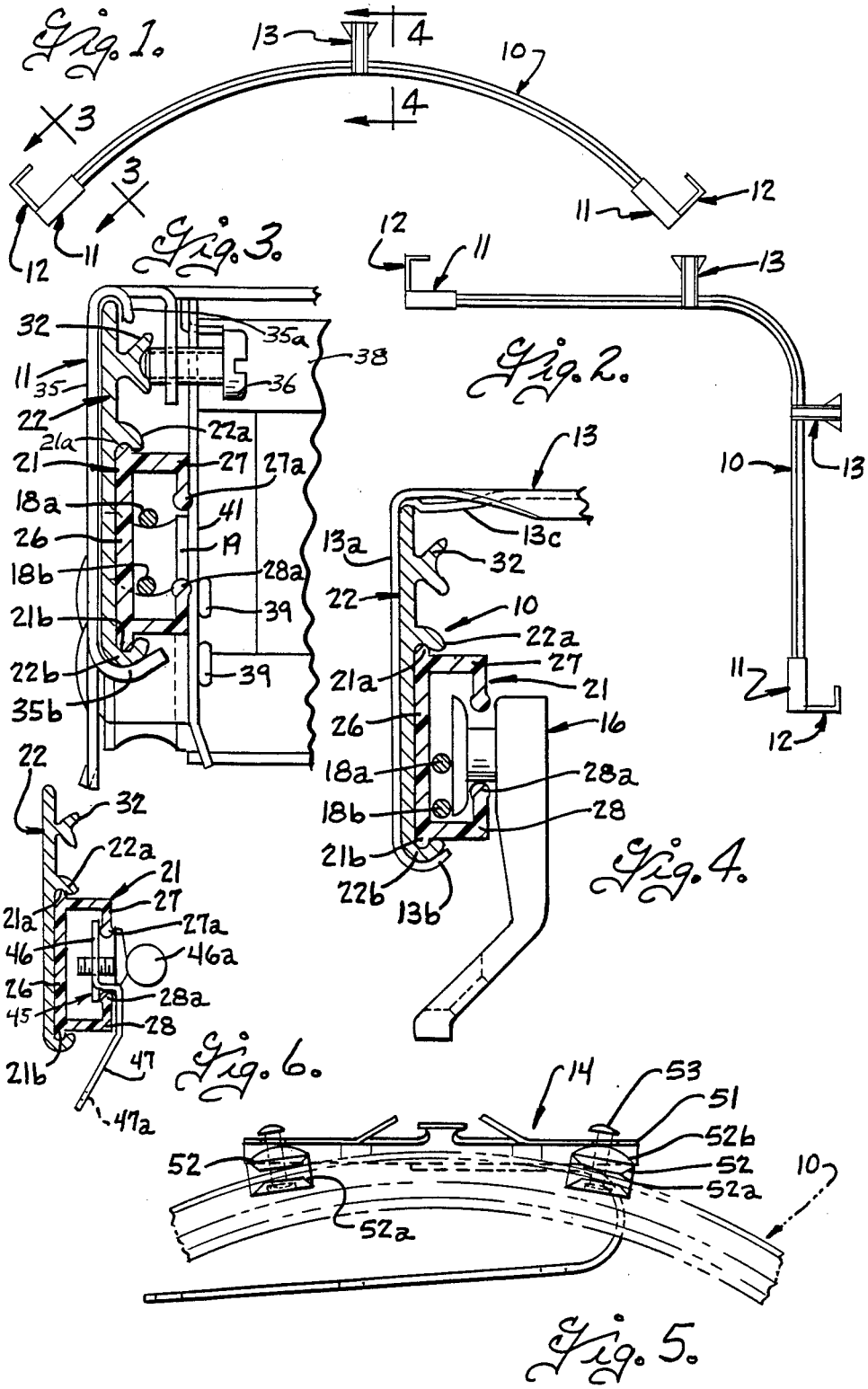
FIG. 1 is a diagrammatic plan view illustrating the drapery rod unit bent into a large radius curve to conform to a bow window.
FIG. 2 is a diagrammatic plan view illustrating an intermediate portion of the drapery rod unit bent into a short radius curve to conform to a corner between two planar wall or window sections.
FIG. 3 is a transverse sectional view through the bendable drapery rod assembly taken on the plane 3—3 of FIG. 1.
FIG. 4 is a transverse sectional view through the bendable drapery rod assembly taken on the plane 4—4 of FIG. 1
FIG. 5 is a fragmentary top plan view of a master carrier illustrating the same on a curved portion of the bendable drapery rod assembly.
FIG. 6 is a fragmentary transverse sectional view of the bendable rod assembly and illustrating a releasable carrier stop mounted on the rod assembly.

The bendable drapery rod 10 is shown in FIGS. 1 and 2 in a drapery rod assembly including end housings 11 and end mounting brackets 12, and one or more intermediate mounting brackets 13. Drapery carriers are mounted for movement along the drapery rod and include at least one master carrier 14 for one-way draw, and two or more master carriers for multiple draw draperies, and a plurality of intermediate or auxiliary carriers 16. As is conventional in drapery rods, the master carrier or carriers are moved along the rod by traverse cord means entrained over pulleys 19 in the end housings 11 and including traverse cord runs designated 18*a* and 18*b* extending lengthwise of the rod and operatively connected to the master carrier or carriers to move the same along the rod.

The drapery rod 10 includes an elongated plastic rod member 21 and an elongated metal rod member 22 extending alongside the plastic rod member, and a retaining means for laterally retaining the plastic rod member and metal rod member together along their length to provide a combination plastic and metal rod unit. The plastic rod member is formed of a flexible plastic and the metal rod member is formed of a ductile metal with a cross section having a major crosswise dimension and a substantially smaller minor crosswise dimension transverse to the major crosswise dimension. The rod mounting means including end brackets 12 and intermediate brackets 13 are arranged to mount the rod unit on a support such as a wall or window frame with the rod unit extending horizontally and with the major crosswise dimension of the metal rod member disposed generally vertically. The combination plastic and metal rod unit is adapted to be bent in a direction laterally of the minor crosswise dimension of the metal rod member into a curved condition, add the metal rod member is formed from metal that is ductile and adapted to take a permanent set without rupturing the metal when the rod unit is bent to aid in retaining the rod unit in a curved condition. The major crosswise dimension of the metal rod member is substantially greater than the minor crosswise dimension to stiffen the rod unit against bending in a direction laterally of the major crosswise dimension.

The plastic rod member 21 is preferably disposed at the rear side of the metal rod member so that the trackway and carriers are substantially concealed from view from the front side of the rod. In the preferred embodiment illustrated, the plastic rod member has a generally C-shaped cross section and includes a lengthwise extending front wall means 26 adapted to be disposed in an upright plane when the rod assembly is installed, and lengthwise extending upper and lower generally L-shaped rail means 27 and 28 integral with the rear side of the front wall means 26 and extending rearwardly therefrom and terminating in lengthwise extending rails 27*a*, 28*a* that are spaced apart to define a lengthwise extending trackway for the drapery carriers 14 and 16. As previously described, the elongated metal rod member 22 is formed with a cross section having a high height-to-width ratio such that it is readily bendable in a horizontal direction into a curved condition, but resists bending in a vertical direction. In the embodiment shown, the metal rod member 22 has a wide flat front face and a rear face generally paralleling the front face, and the lower portion of the rear face is adapted to extend alongside the forward face of the front wall means 26 of the plastic rod member 21. The retaining means is arranged to laterally retain the rod members together while accommodating limited relative movement therebetween in a direction lengthwise of the rod members to facilitate bending of the rod unit. The metal rod member is conveniently formed by extrusion and the retaining means comprises upper and lower generally L-shaped retaining flanges 22*a* and 22*b* extending from the rear face of the metal rod member with the L-shaped retaining flanges in opposed relation and arranged to slidably receive upper and lower flanges 21*a* and 21*b* on the plastic rod member 21.

A stiffening rail 32 is advantageously provided on the metal rod member 22 at a location above the upper retaining flange 22*a*. In the embodiment illustrated the rail 32 has a generally Y-shaped configuration and extends rearwardly from the rear side 22*b* of the rod unit at a location spaced above the upper flange 22*a*. The intermediate mounting brackets 13 are arranged to engage the metal rod member and, as shown in FIG. 4, the intermediate bracket 13 extends over the upper edge of the metal rod member and has a strap portion 13*a* that extends downwardly along the front of the metal rod member and terminates in a hook or saddle portion 13*b* that engages the lower edge of the metal rod member. The saddle portion 13*b* retains the lower edge of the metal rod member on the intermediate bracket and a latch, conveniently in the form of a resilient tab 13*c* is provided on the bracket 13 for releasably retaining the upper portion of the metal rod member in position alongside the strap portion 13*a*.

The pulley housings 11 are preferably arranged to engage the metal rod member 22 and to support the rod unit on the mounting brackets 12. As best shown in FIG. 3, the pulley housings 11 have a face wall 35 arranged to overlie the front side 22*a* of the metal rod member and upper and lower U-shaped flange portions 35*a* and 35*b* arranged to overlie the upper and lower edges of the metal rod member to laterally retain the same. A means such as a screw 36 is mounted on the pulley housing and arranged to engage the rail 32 on the metal rod unit to retain the pulley housing against axial withdrawal from the metal rod unit. The pulley housing has a laterally extending portion 38 which is adapted to be mounted on the brackets 12 to support the pulley housing and rod unit on a support surface. The cord guide pulleys 19 are mounted as by rivets 39 that extend between the front wall 35 of the pulley housing and a rear cover plate 41. As best shown in FIG. 3, the traverse cord runs 18*a* and 18*b* extend from the C-shaped plastic rod unit and over the pulleys 19 in the pulley housings. As is well understood in the art, the traverse cord means extends around the pulleys at the ends of the rod assembly and at least one of the runs of the traverse cord is connected intermediate its ends to the master carrier 14 to move the master carrier along the rod in response to drawing one or the other of the traverse cords runs.

As shown in FIG. 6, a slide stop 45 is mounted on the plastic rod member 21 to stop movement of the slides out of the end of the trackway in the plastic rod member. The slide stop 45 has a head 46 adapted to engage the inner side of the upper and lower rails 27*a* and 28*a* of the plastic rod member and a thumb screw 46*a* is threaded into the head 46 and arranged to engage the outer side of the rails 27*a* and 28*a* for locking the slide stop in a position on the plastic rod member. The slide stop also has a depending drapery support portion 47 that extends downwardly at the rear side of the plastic rod member with an opening 47a in its lower end for receiving a drapery hook. The plastic rod member is usually at the outer side of the curve when the rod unit is bent and, because of the differences in the radius of curvature of the metal and plastic rod members, the ends of the plastic rod member will tend to shift inwardly from the pulley housing at the end of the metal rod member. When the carrier stop is mounted on an end of the plastic rod member before the rod unit is bent, the carrier stop and the drapery support portion thereon will automatically move with the end of the plastic rod member relative to the metal rod member and relative to the pulley housing mounted on the metal rod member.

The master carrier 14 is constructed and arranged to allow free sliding movement along the trackway in the plastic rod member, in both straight and curved portions thereof. As best shown in FIG. 5, the master carrier 14 includes a rigid body 51 and guide buttons 52 having upper and lower slots 52a for slidably receiving the upper and lower rails 27a, 27b on the plastic rod member. The guide buttons 52 are supported as by rivets 53 on the slide body in such a manner as to allow limited tilting of the slide buttons in a horizontal plane relative to the body. As shown in FIG. 5, the buttons 52 have an arcuate rear face 52b as viewed in plan and the heads of the rivets 53 are spaced from the arcuate rear face 52b a distance substantially greater than the thickness of the slide body, and the rivet receiving openings in the slide body are made sufficiently larger than the rivets, to allow the buttons 52 to tilt in a horizontal plane relative to the slide body, as the carrier moves along a curved section of the trackway.

In general, the force required to bend the combination plastic and metal rod unit in the horizontal direction is a combination of the force required to bend the plastic rod member and the force required to bend the metal rod member. Thus, the force required to bend the combination plastic and metal rod unit is dependent on moment of inertia of the plastic rod member with respect to a vertical axis through the center of gravity of its cross section and the modulus of elasticity of the plastic, and the moment of inertia of the metal rod member with respect to a vertical axis through the center of gravity of its cross section and the modulus of elasticity of the metal. The plastic rod member 21 which forms the trackway must be sufficiently large to provide space for the drapery carriers and traverse cords and the plastic rod member accordingly has a cross section with a relatively high moment of inertia with respect to a vertical axis through the center of gravity of its cross section. In order to facilitate bending of the rod unit, the plastic rod member is also preferably constructed and arranged with its minor transverse dimension disposed horizontally and its major transverse dimension disposed vertically. The plastic material used in the plastic rod member is selected to be sufficiently flexible to enable the plastic rod member to be readily bent into curves having a radius of curvature as low as 12 or 15 inches without fracturing the plastic rod member or excessively distorting its cross section, and yet be sufficiently rigid to avoid distortion of the trackway under the weight of the draperies on the carriers. The plastic rod member formed of such rigid plastic is resiliently bendable and tends to return to its normal straight condition when bending forces are removed.

The metal rod member is formed of a ductile metal and with a stiffness in flexure greater than the stiffness in flexure of the plastic rod member such that the metal rod member will take a permanent set to aid in retaining the plastic rod member in a curved condition when the rod unit is bent. The metal in the metal rod member 22 is selected to have a modulus of elasticity many times higher than the modulus of elasticity of the plastic used in the plastic rod member and the metal rod member is formed with a cross section having a moment of inertia with respect to a vertical axis through the center of gravity of its cross section which is substantially lower than the moment of inertia of the plastic rod member and such that the metal rod member can be readily bent into curves having a radius of curvature as low as about 12 or 15 inches without rupturing the metal rod member or excessively distorting its cross section. The metal in the metal rod member is also selected to be ductile and with a yield strength such that the metal rod member can be easily bent into a curve and stressed beyond its elastic limit at the outside of the curve to take a permanent set, at least when the metal rod member is bent into small radius curves, to hold the rod unit in a curved condition. As is known, when a ductile metal is stressed beyond its elastic limit, permanent strain occurs and, when the stress is released, the metal will contract along a line generally parallel to the original elastic line leaving a permanent set. Thus, when the combination metal and plastic rod unit is bent into a curve that stresses the metal rod member at the outside of the curve beyond its elastic limit, and the bending forces are thereafter released, the metal rod member will only partially return toward a straight condition. Thus, to form the rod unit into a permanent curve of a desired curvature, the rod unit should be bent to a curve having a radius somewhat smaller than the desired curvature, so that the rod unit will return toward the desired curvature when the bending stresses are released. In practice, it is not necessary to form the rod unit into the exact curve desired since the rod mounting brackets 14, 15 are adapted to apply some lateral forces to the rod unit which can compensate for some deviation of the permanent rod curve from the desired curve. Since the rod unit is usually bent into a curve with the front face of the metal rod member at the inside of the curve, most of the stress and hence permanent strain in the metal rod member occurs in the flanges 22a, 22b and rail 32 at the outside of the curve.

It is desirable that the combination plastic and metal rod unit be bendable by hand, that is by applying lateral bending forces or force couples to the rod unit with forces that the rod installer can apply using his two hands and arms, without requiring special bending tools and while the rod unit is the normal range of room temperatures. The installer can bend the rod unit before installation to approximate the desired curve by grasping the rod with his hands at spaced locations, for example at locations spaced two feet apart, and applying lateral bending forces to the rod unit in a direction laterally of the minor transverse dimension. The rod unit can also be bent during installation. For example, when installing the bendable rod on a bowed window, the mounting brackets can first be attached to the supporting wall or surface at the desired spaced locations, usually not more than two feet apart. The bendable rod can then be mounted on one bracket and pulled laterally into a curve before mounting the rod on the next bracket, and so on. Based on information obtained from the book "Industrial Ergonomics" by David C. Alexander and Babur M. Pulat, it is considered that the average rod installer can readily exert a bending moment or force couple on the rod unit, either before or during installation, of about fifty foot pounds, by hand and without use of bending tools. The rod unit is preferably bendable in a direction laterally of the minor crosswise dimension of metal rod member by applying a bending moment of this order of magnitude, or less.

As previously described, the total force required to bend the combination metal and plastic rod unit will vary dependant on the modulus of elasticity of the metal and the plastic and the moment of inertia of the metal and plastic rod members with respect to the vertical axis through their centers of gravity. The plastic rod member 21 is preferably formed of a rigid plastic such as polyvinyl chloride having a modulus of elasticity in the range of about 200,000 to 600,000 psi, and the metal in the metal rod member is preferably formed of ductile metal such as aluminum having a modulus of elasticity of the order of 10,000,000 psi. Aluminum will take a permanent set at very low strains, for example at 0.2% elongation, while rigid polyvinyl chloride will not take a permanent set until the strain is many times higher. Thus, the plastic rod member, when bent through arcs of even relatively small radius of the order of 12 to 15 inches, is not strained beyond its elastic limit and, upon removal of the stress, the plastic rod member tends to return to its original generally straight condition. However, the metal rod member, when bent through arcs of even relatively large radius will be strained beyond its elastic limit at the outside of the curve and take a permanent set. Since the modulus of elasticity of the metal is substantially greater than that of the plastic, the bent metal rod member will aid in holding the plastic rod member in a curved condition. For example, a plastic rod member having the cross section shown in the drawings with a vertical height of about 0.75 inches, and a horizontal width of about 0.28 inches, and a wall thickness of about 0.05 inches, has a moment of inertia with respect to a vertical axis through the center of gravity of its cross section of about 0.00068 in.$^4$. Such a plastic rod member, formed of a rigid polyvinyl chloride plastic sold by B. F. Goodrich under the designation "GEON" 85853-138, and having a modulus of elasticity of about 420,000 psi, can be bent at normal room temperature into a horizontal curve of a radius of twelve inches with a bending moment of about four foot pounds. A metal rod member having a cross section as shown in the drawings, with a vertical height of 1.31 inches, a horizontal width of 0.160 inches, and a wall thickness of about 0.050 inches, has a moment of inertia with respect to a vertical axis through the center of gravity of its cross section of about 0.00014 in.$^4$. Such a metal rod member, formed of an aluminum alloy marketed by Alcoa under the designation 6063 T5, and having a modulus of elasticity of about 10,000,000 psi, can be bent into a horizontal curve of twelve inch radius with a bending moment of about eight foot pounds. Thus, the total bending force required to bend a rod unit formed by such metal and plastic rod members is about twelve foot pounds and such a rod unit can easily be bent by hand. The aluminum alloy 6063 T5 has yield strength of about 21,000 psi at 0.2% elongation. A metal rod member formed with the cross section described above, will be strained beyond its elastic limit at the outside of the curve and take a permanent set when bent into small radius curves of the order of 12 to 15 inches and even in larger curves having a radius of three or four feet. The combination metal and plastic rod unit can be formed into shape retaining curves of larger curves by bending the rod unit into a sufficiently small curve to exceed the elastic limit of the metal rod member and then releasing the bending forces and applying bending forces in the opposite direction sufficient to partially straighten the rod unit into the desired curve. The plastic rod unit is not stressed beyond its elastic limit even when bent into a 12 inch radius curve, and tends to return to its original position. However, the aluminum rod member when bent into a 12 inch radius curve is stressed beyond its elastic limit and takes a permanent set. Since the force required to bend the metal rod member into a 12 inch radius is substantially greater than the force that the plastic rod member exerts in trying to return to a straight condition, the metal rod member will hold the rod unit in a curved condition.

The embodiments of the invention in which an exclusive property or privilege is claimed are defined as follows:

1. A bendable drapery rod assembly comprising an elongated plastic rod member formed of flexible plastic and including lengthwise extending rail means defining a trackway for drapery carriers, an elongated metal rod member of ductile metal having a major crosswise dimension and a relatively smaller minor crosswise dimension transverse to the major crosswise dimension, means for laterally retaining the plastic rod member and metal rod member together along their length to provide a combination plastic and metal rod unit, rod mounting means for mounting the rod unit on a support with the rod unit extending horizontally and with the major crosswise dimension of the metal rod member disposed generally vertically, the rod unit being bendable in a direction laterally of the minor crosswise dimension of the metal rod member into a curved condition, and the metal member being ductile and adapted to take a permanent set when bent to aid in retaining the plastic rod member in a curved condition, the major crosswise dimension of the metal rod member being substantially greater than the minor crosswise dimension to stiffen the rod unit against bending in a direction laterally of the major crosswise dimension, said plastic rod member having generally C-shaped cross section including a lengthwise extending first wall means disposed in an upright plane and lengthwise extending upper and lower rails projecting laterally from the first wall means and defining said trackway for drapery carriers, said metal rod member having a lengthwise extending first wall means disposed in an upright plane alongside the first wall means of the plastic rod member, said means for laterally retaining the plastic and metal rod members together including lengthwise extending flanges integral with the metal rod member and engaging the plastic rod member.

2. A bendable drapery rod assembly according to claim 1 wherein the means for laterally retaining the rod members together is further arranged to accommodate limited relative movement therebetween in a direction lengthwise of the rod members to facilitate bending of the rod unit.

3. A bendable drapery rod assembly according to claim 1 wherein the metal rod member and the plastic rod member have different cross sections, said plastic rod member having a moment of inertia with respect to a vertical axis through a center of gravity of the cross section thereof that is substantially greater than the moment of inertia of the metal rod member with respect to a vertical axis through a center of gravity of the cross section thereof.

4. A bendable drapery rod assembly according to claim 1 wherein the metal rod member and the plastic rod member have different cross sections, said plastic rod member having a moment of inertia with respect to a vertical axis through a center of gravity of the cross section thereof that is substantially greater than the moment of inertia of the metal rod member with respect to a vertical axis through a center of gravity of the cross section thereof, the ductile metal of the metal rod member having a modulus of elasticity substantially greater than the modulus of elasticity of the flexible plastic rod member.

5. A bendable drapery rod assembly according to claim 1 wherein the metal rod member has a stiffness in flexure substantially greater than the plastic rod member.

6. A bendable drapery rod assembly according to claim 1 wherein the rod unit is bendable by hand in a direction laterally of the minor crosswise dimension of the metal rod member into a curved condition and without requiring bending tools or heating of the rod unit.

7. A bendable drapery rod assembly according to claim 1 wherein the first wall means of the plastic rod member includes integral upper and lower flanges projecting above and below the upper and lower rails respectively, the flanges on the metal rod member engaging the upper and lower flanges on the first lengthwise extending plastic rod member.

8. A bendable drapery rod assembly comprising an elongated plastic rod member formed of flexible plastic and including lengthwise extending rail means defining a trackway for drapery carriers, an elongated metal rod member of ductile metal having a major crosswise dimension and a relatively smaller minor crosswise dimension transverse to the major crosswise dimension, means for laterally retaining the plastic rod member and metal rod member together along their length to provide a combination plastic and metal rod unit, rod mounting means for mounting the rod unit on a support with the rod unit extending horizontally and with the major crosswise dimension of the metal rod member disposed generally vertically, the rod unit being bendable in a direction laterally of the minor crosswise dimension of the metal rod member into a curved condition, and the metal member being ductile and adapted to take a permanent set when bent to aid in retaining the plastic rod member in a curved condition, the major crosswise dimension of the metal rod member being substantially greater than the minor crosswise dimension to stiffen the rod unit against bending in a direction laterally of the major crosswise dimension, said plastic rod member having a generally C-shaped cross section including a first lengthwise extending wall means disposed in an upright plane and upper and lower lengthwise extending rails projecting laterally from the first wall means and defining said trackway for drapery carriers, said metal rod member having a lengthwise extending first wall means disposed in an upright plane alongside the first wall means of the plastic rod member, said means for laterally retaining the plastic and metal rod members together including lengthwise extending first and second flanges integral with the metal rod member and engaging the plastic rod member, and a lengthwise extending stiffening rail means on the metal rod member spaced above the first and second flanges.

9. A bendable drapery rod assembly according to claim 8 wherein the plastic rod member has a moment of inertia with respect to a vertical axis through a center of gravity of the cross section thereof that is substantially greater than the moment of inertia of the metal rod member with respect to a vertical axis through a center of gravity of the cross section thereof.

10. A bendable drapery rod assembly according to claim 8 wherein the plastic rod member has a moment of inertia with respect to a vertical axis through a center of gravity of the cross section thereof that is substantially greater than the moment of inertia of the metal rod member with respect to a vertical axis through a center of gravity of the cross section thereof, the ductile metal of the metal rod member having a modulus of elasticity substantially greater than the modulus of elasticity of the flexible plastic of the plastic rod member.

11. A bendable drapery rod assembly comprising, an elongated plastic rod member formed of flexible plastic and including a lengthwise extending first wall means having opposite sides and lengthwise extending rail means defining a trackway for drapery carriers, an elongated metal rod member of ductile metal having lengthwise extending side faces, means for laterally retaining the elongated metal rod member and the elongated plastic rod member together along their length with one side face of the metal rod member engaging one side of said first wall means of the plastic rod member to provide a combination plastic and metal rod unit, rod mounting means for mounting the rod unit on a support with the rod unit extending horizontally and with the side faces of the metal rod member disposed generally vertically, the rod unit being bendable in a first direction laterally of said first wall means into a curved condition, the elongated metal rod member being ductile and adapted to take a permanent set when bent to aid in retaining the plastic rod member in a curved condition, the metal rod member having a major crosswise dimension paralleling said one side of the first wall means to stiffen the rod unit against bending in a direction transverse to said direction, the means for laterally retaining the metal rod member and plastic rod member together including first and second flanges integral with the elongated metal rod member and extending laterally of said one side face of the metal rod member for engagement with the elongated plastic rod member.

12. A bendable drapery rod assembly according to claim 11 wherein said rail means are disposed at the side of said first wall means opposite said one side of the first wall means.

13. A bendable drapery rod assembly according to claim 11 wherein the metal rod member and the plastic rod member have different cross sections, said plastic rod member having a moment of inertia with respect to a vertical axis through a center of gravity of the cross section thereof that is substantially greater than the moment of inertia of the metal rod member with respect to a vertical axis through a center of gravity of the cross section thereof.

14. A bendable drapery rod assembly according to claim 11 wherein the metal rod member and the plastic rod member have different cross sections, said plastic rod member having a moment of inertia with respect to a vertical axis through a center of gravity of the cross section thereof that is substantially greater than the moment of inertia of the metal rod member with respect to a vertical axis through a center of gravity of the cross section thereof, the ductile metal of the metal rod member having a modulus of elasticity substantially greater than the modulus of elasticity of the flexible plastic of the plastic rod member.

15. A bendable drapery rod assembly according to claim 11 including a pulley housing mounted on at least one end of the metal rod member, and a carrier stop mounted on an end of the plastic rod member adjacent the pulley housing.

16. A bendable drapery rod assembly comprising an elongated plastic rod member formed of flexible plastic and including a front wall and lengthwise extending lower and upper rail means of generally L-shaped cross section projecting rearwardly from the front wall and defining a rear trackway for drapery carriers, an elongated metal rod member of ductile metal having a front face and a rear face generally paralleling the front face and integral upper and lower flange means on the rear face for engaging and for laterally retaining the plastic rod member on the metal rod member with the front wall of the plastic rod member engaging the rear face of the metal rod member to provide a combination plastic and metal rod unit, rod mounting means for mounting the rod unit on a support with the rod unit extending horizontally and with the front face of the metal rod member disposed generally vertically, the metal rod member having a cross section with a major crosswise dimension paralleling the front face thereof and a relatively smaller crosswise dimension transverse to the front face thereof, the plastic rod member having cross section with a major crosswise dimension paralleling the front wall thereof and a relatively smaller minor crosswise dimension transverse to the front wall, the rod unit being bendable in a direction laterally of the minor crosswise dimension of the metal rod member into a curved condition, and the metal member being ductile and adapted to take a permanent set when bent to aid in retaining the plastic rod member in a curved condition, the major crosswise dimension of the metal rod member being substantially greater than the minor crosswise dimension to stiffen the rod unit against bending in a direction laterally of the major crosswise dimension, said plastic rod member having a moment of inertia with respect to a vertical axis through a center of gravity of the cross section thereof that is substantially greater than the moment of inertia of the metal rod member with respect to a vertical axis through a center of gravity of the cross section thereof, the ductile metal of the metal rod member having a modulus of elasticity substantially greater than the modulus of elasticity of the flexible plastic of the plastic rod member.

17. A bendable drapery rod assembly according to claim 16 wherein said front wall of the plastic rod member includes integral upper and lower flanges projecting above and below the upper and lower rail means respectively, the upper and lower flange means on the metal rod member engaging the upper and lower flanges on the front wall of the plastic rod member.

* * * * *